United States Patent [19]

Murphy

[11] Patent Number: 4,804,149

[45] Date of Patent: Feb. 14, 1989

[54] TOILET PAPER DISPENSER

[76] Inventor: James Murphy, 5080 San Anselmo St., Las Vegas, Nev. 89120

[21] Appl. No.: 84,846

[22] Filed: Aug. 13, 1987

[51] Int. Cl.[4] ..... B65H 19/00

[52] U.S. Cl. ..... 242/55.53

[58] Field of Search ..... 242/55.2, 55.53; 206/389, 409; 312/38, 39

[56] References Cited

U.S. PATENT DOCUMENTS

| | | | |
|---|---|---|---|
| 438,567 | 10/1890 | Wheeler | 242/55.2 |
| 1,464,983 | 8/1923 | Fleischmann | 312/39 |
| 2,232,968 | 2/1941 | Price et al. | 242/55.53 X |
| 2,288,332 | 6/1942 | Steiner et al. | 312/39 |
| 2,606,724 | 8/1952 | Hertz | 242/55.53 X |
| 2,639,099 | 5/1953 | Gough, Jr. | 242/55.53 X |
| 3,259,287 | 7/1966 | Spiker | 312/39 X |

FOREIGN PATENT DOCUMENTS

| | | | |
|---|---|---|---|
| 246637 | 1/1947 | Switzerland | 242/55.2 |

*Primary Examiner*—David Werner

*Attorney, Agent, or Firm*—Seiler, Quirk & Tratos

[57] ABSTRACT

A toilet paper dispenser has a housing having flat side walls and a U-shaped front wall forming an interior roll containing chamber. Paper on the roll threads through an opening at the front of the housing. A spool which journals through the toilet paper roll is supported in the chamber on a pair of spaced parallel tracks which slope downwardly toward the front of the housing, thereby urging a roll of paper mounted on the spool toward the front of the housing.

6 Claims, 2 Drawing Sheets

FIGURE 1.
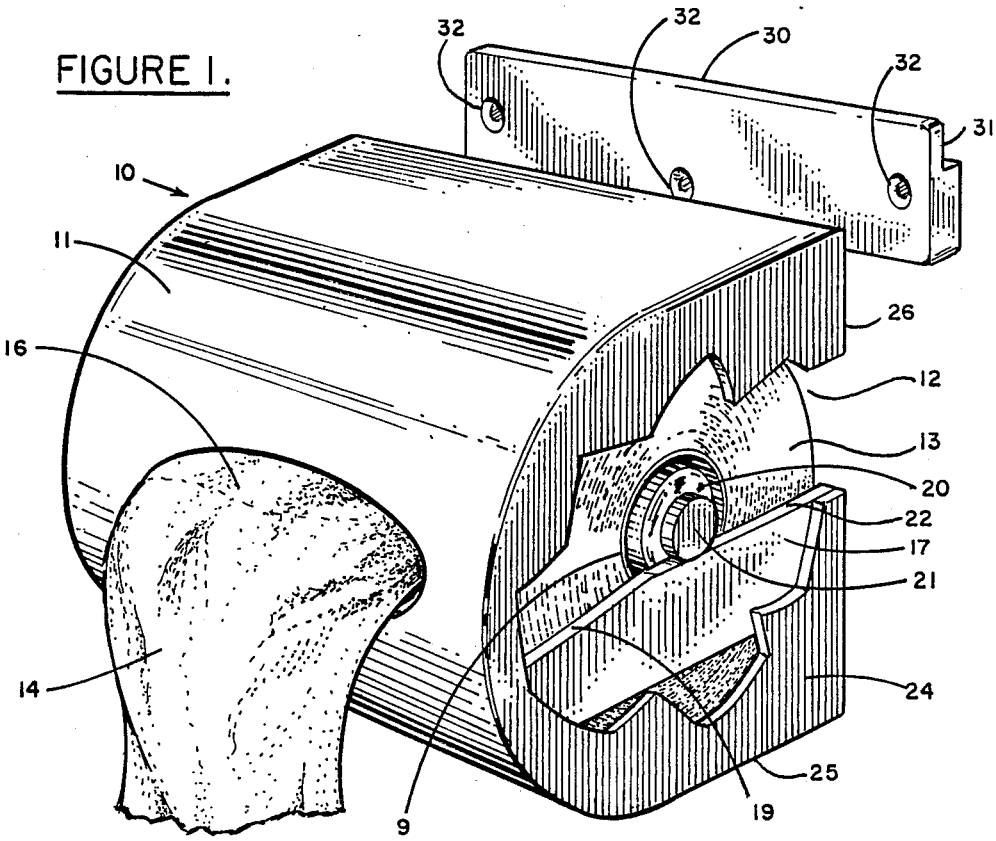
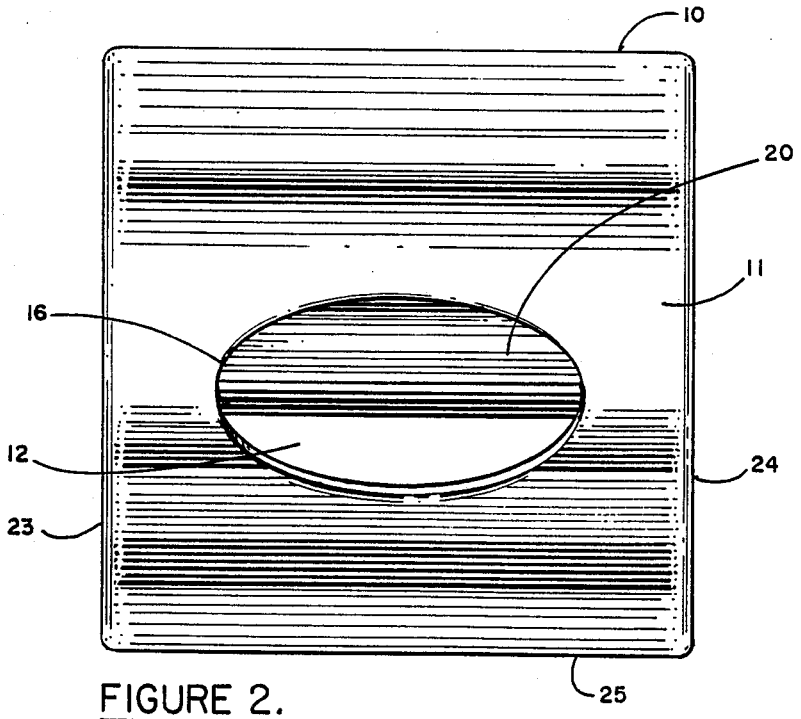
FIGURE 2.

TOILET PAPER DISPENSER

BACKGROUND OF THE INVENTION

This invention relates to a wall-mountable dispenser for rolls of toilet paper. More particularly, the invention relates to a decorative housing which is easily and quickly mounted on a wall, and which has an interior chamber having tracks upon which a spool extending through a toilet paper roll can rotate.

Many different toilet paper dispensing devices have been used over the years. As homeowners become more concerned with decorative items for bathrooms, toilet paper dispensers have assumed various configurations and colors. Most dispensing devices have certain common features, however, including a rotating spool extending through the hollow core of the toilet paper roll around which the roll rotates as the tissue is dispensed. Examples of prior art dispensers include Wheeler, U.S. Pat. No. 438,567, and Sifferman, U. S. Pat. No. 1,772,917. The Wheeler patent discloses a wall-mounted roll holder having a small spindle which extends axially through a roll supporting spool travels downwardly and rearwardly in channels of a mounting bracket as paper is removed from the roll. The bracket also includes a locking mechanism to preclude the roll from being removed until all of the paper has been used up. The Sifferman patent describes a mounting bracket having telescoping arms which act as spool mounts to suspend a toilet paper roll outside of a wall cavity until the roll is reduced in size sufficiently to enter the cavity. The arms can be folded and secured inside the center portion of the toilet paper roll when the roll is placed into the cavity.

The invention contemplates a simple, easily manufactured, yet decorative toilet paper dispensing device which completely encloses the roll, thereby precluding its contamination by dust or water. The continuous sheet of paper is threaded through an oval opening in the front of the housing. The roll is mounted on a spool having rollers on each end that engage tracks mounted on the interior of the housing; the tracks are inclined forwardly to maintain the roll at a forward portion of the housing as the roll is depleted. Individual sheets of paper are easily torn from the roll without spinning the spool because of friction between the housing and the forward potion of the roll, and between the edges of the sheet being removed and the opening or slot through which the tissue extends.

Accordingly, it is the object of the present invention to provide a toilet paper dispenser which is easily and inexpensively manufactured, and which may be quickly wall mounted by a purchaser. It is another object of the invention to provide a decorative toilet paper dispenser which substantially entirely encloses the paper roll, but in which is easy to replace paper rolls and to remove segments of paper. It is yet another object of the invention to provide a toilet paper dispenser which automatically adjusts to a decreasing roll size. These and other objects of the invention are accomplished by the paper dispenser of the invention, a preferred embodiment of which is disclosed herein.

SUMMARY OF THE INVENTION

A device for dispensing a cylindrical toilet paper roll has a housing with two spaced parallel flat side wall joined by a generally U-shaped curved front wall. An opening in the back permits removal and insertion of a toilet paper roll into a chamber formed by the walls. A slot or generally oval shaped opening in a forward portion of the front wall permits threading of the sheets of paper for access by a user.

The operating mechanism of the dispenser includes a pair of spaced parallel tracks mounted on the interiors of the side walls upon which end portions of a coaxial spool rest. The end portions constitute rollers which have a smaller diameter than the spool body. The tracks have a horizontal portion near the rear of the housing, and a second portion which slopes downwardly and forwardly toward the front of the housing.

The housing is mounted by a downwardly extending flange at the rear of the housing which extends over a mated upwardly extending flange on a wall-mountable bracket.

BRIEF DESCRIPTION OF THE DRAWINGS

The invention is best understood with reference to the drawings, in which:

FIG. 1 shows a partially cut away perspective view of the toilet paper dispenser of the invention, with the housing portion exploded away from the mounting bracket;

FIG. 2 shows a front view of the dispenser;

DESCRIPTION OF A PREFERRED EMBODIMENT

Figure 3:
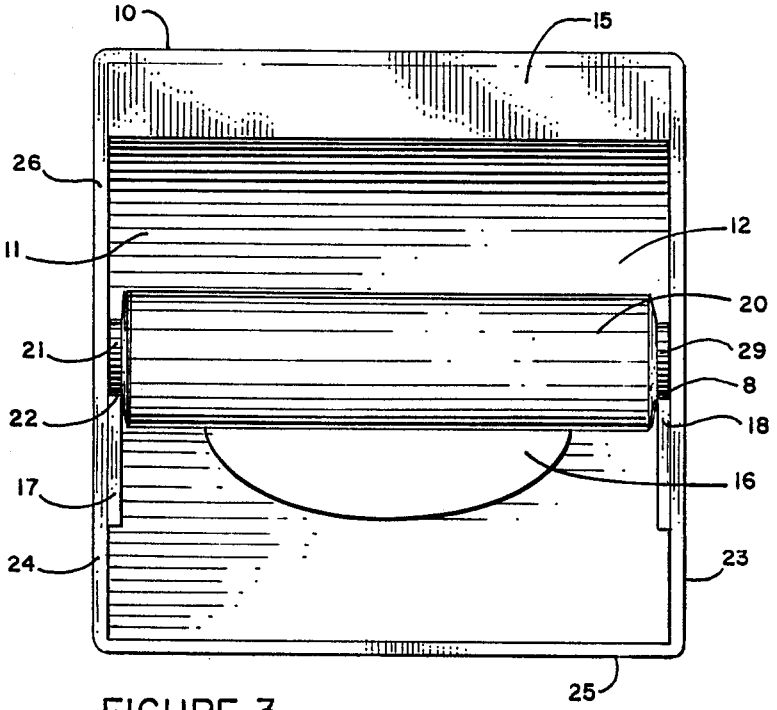
FIG. 3 shows a rear view of the dispenser with the spool in place upon the tracks.

Referring first to FIG. 1, the toilet paper dispenser of the invention consists of three parts, including a housing 10, a mounting bracket 30, and a spool 20. A conventional roll of toilet tissue consisting an elongate sheet of tissue paper having uniformly spaced transverse perforations mounted on a cardboard tube 9 is shown enclosed in the housing. The housing comprises a pair of parallel spaced flat side walls 23 and 24 (see FIGS. 2 and 3), and a generally U-shaped wall 11 extending between the side walls. The U-shaped wall 11 has a generally flat horizontal upper portion 27 and lower portion 25 at the rear of the U-shaped wall. An oval opening 16 is located in curved wall 11 at a forward portion of the housing to permit the end portion 14 of the tissue roll to be accessed by a user. The walls of the housing form an interior roll-receiving chamber 12; the rear portion of the housing is open as shown in FIG. 3 for easy insertion and removal of a toilet paper roll.

The operating mechanism of the dispenser of the invention has a very simple, yet very important design. The toilet paper roll 13 is supported by spool coaxial 20 which is mounted in the tube 9 which constitutes the roll support. The spool diameter is relatively large (e.g., about 1½") to eliminate eccentricity and bouncing sometimes associated with smaller spools. As best seen in FIG. 3, a pair of axial lugs 21 and 29 extend outwardly from the spool body; these lugs have a diameter of from about 0.2–0.8 of the diameter of the spool body and act as rollers or bearings which engage tracks or races mounted interiorly of the housing as hereinafter described. The lugs have a cylindrical shape.

The guide members 17 and 18 are mounted on the interior surfaces of walls 24 and 23, respectively. The upper edges of the guide members are flat and act as tracks upon which the lugs 21 and 29 rest. As paper is removed from the roll and shown in FIG. 1, the lugs simply spin around on the track, the lug acting as a bearing and the track as a race. The upper edges of the guides 17 and 18 are parallel, horizontal, and uniformly spaced from each other. The tracks consist of rear horizontal portions 8 and 22, which extend from the rear of the housing to a point approximately midway toward the forward edge of the housing, and downwardly sloped portions 6 and 19 which extend from about the mid-portion of the housing to the front wall. The downwardly sloped portion of the track permits a gravity biasing of the roll toward the front of the housing, maintaining a position of the roll at the forwardmost portion of the housing regardless of the amount of paper remaining on the roll. Biasing of the roll toward the front wall of the housing creates a slight amount of friction between the outer layer of the paper and the interior wall of the housing, thereby enabling a user to easily remove a segment of the roll along one of the transverse perforations by pulling on the end sheet without causing the roll to spin, thereby discharging undesired quantities of paper.

To achieve the desired result, the forward portion of the track should be sloped at least 5°, and preferably 10°-20°, downwardly from horizontal. Slopes of greater than about 30° have been found to create difficulty in easily removing the paper. While the track has been shown in two segments (i.e., a horizontal rear section and a downwardly sloped forward section), the tracks may be a continuous, slightly curved configuration. A generally horizontal rearward track portion has been found to be preferable since the inherent inertia in removing paper from a full roll does not require the same friction with the housing as when the roll becomes substantially depleted.

Figure 4:
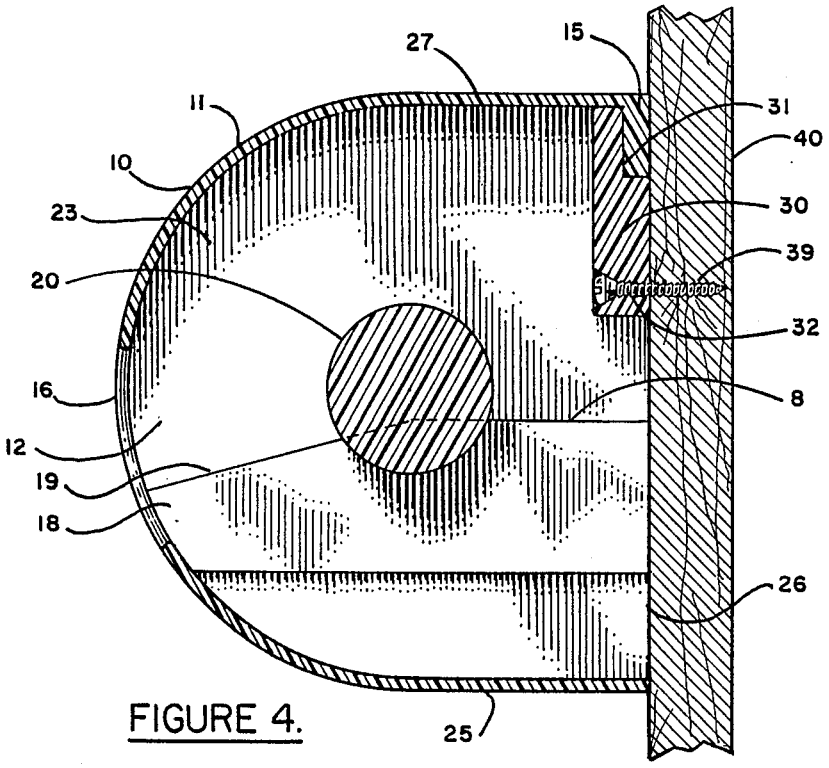
FIG. 4 shows a side section view of the dispenser mounted on a wall.

Separation of the paper segments is also aided by the shape and size of the oval opening 16 through which the paper is threaded for use. While the slot 16 is shown as an oval, it may have a different geometric configuration (e.g., rectangular or irregular) if desired. The oval shape is generally considered to be geometrically pleasing, fitting the other curvatures of the housing wall. The width of the opening at its widest point is slightly less than the width of the paper roll, thus creating a slight friction between the edges of the paper segment extending therethrough and the peripheral edge of the opening. This also enables a steady feeding of the paper from the roll, helping to prevent the roll of paper from overspinning. The preferred maximum width of the opening is from 3¾" to about 4¼"; the width of a standard toilet paper roll is 4½". The opening 16 is located slightly below the horizontal axis of the housing, as seen in FIGS. 3 and 4, to provide for a smooth flow of tissue through the slot. The center of the slot is located at an angle of 5°-20° below the center of the front wall as measured from a center point at the rear plane of the housing.

The housing has a rear peripheral edge 26 which is planar and is adapted to mount flush against a vertical wall. The housing has an integrally molded downwardly projecting flange 15 at the top rear portion of the housing which is adapted to fit slideably over the upwardly projecting lip or flange 31 of mounting bracket 30 (see FIGS. 1 and 4). Mounting bracket 30 consists of an elongate bar having a flat back surface adapted to fit flat against the wall. The bracket has a series of spaced transverse bores 32 having countersunk openings to receive wood screws 39. The housing is placed on the mounting bracket simply by sliding the flange 15 over the lip of the mounting bracket 31 as shown in FIG. 4. While the mounting bracket shown is simple and effective, obviously other methods of mounting the housing to a wall may be used.

Use of the paper dispenser of the invention is very simple. The spool 20 is inserted through the axial tube of a toilet paper roll, and the assembly is inserted into the rear opening of the housing. Next, the end of the roll is threaded through the opening at the front of the housing. Finally, the entire assembly is fitted to the mounting bracket as shown in FIG. 4. The entire loading and replacement of the unit can be done in just a few seconds.

The dispenser of the invention may be made from any suitable material, such as wood, metal, or plastic. The configuration of the housing is particularly adaptable to injection molding of plastic; any moldable plastic, such as polyethylene, polypropylene, polyvinylchloride, or any other thermoplastic material may be used.

The apparatus has been particularly designed for safety, without any sharp edges, and is pet-proof and child proof. While the invention has been described with respect to a specific embodiment thereof, various modifications may be made within the spirit and scope of the invention and will be obvious to persons skilled in the art. Accordingly, the invention should not be considered limited by the foregoing description of a specific embodiment thereof; rather, the description should be considered illustrative rather than definitive. Accordingly, the invention should be limited only by the following claims.

I claim:

1. Apparatus for dispensing a cylindrical roll of paper having an axial opening therethrough comprising:

a housing having first and second flat opposing side walls and a curved front wall, said side walls and front wall forming an interior chamber adapted to enclose said roll of paper, said housing having a rear opening for insertion of the roll of paper and an aperture in the front wall through which the paper is threaded for dispensing, first and second spaced parallel track means, interior of the chamber, said track means sloping downwardly toward a front portion of the chamber and having a substantially horizontal rear portion, and a straight, downwardly sloping forward portion at a angle of from about 5° to about 30° from horizontal, a spool adapted to journal through the axial opening in the roll of paper, said spool having cylindrical roller means extending axially from end portions thereof, said roller means adapted to engage the track means, and mounting means for mounting the housing on a vertical surface.

2. The apparatus of claim 1 wherein the forward portion of the track means slopes downwardly at an angle of at least 5° to horizontal.

3. The apparatus of claim 1 wherein the forward portion of the track means slopes downwardly and forwardly at an angle from about 10° to about 25° to horizontal.

4. The apparatus of claim 1 wherein the track means comprise a flat upper edge of a guide member mounted on an interior wall of the chamber.

5. The apparatus of claim 1 wherein the mounting means comprises a downwardly extending flange at an upper rear portion of the housing, and a wall mountable bracket having receiving means to engage the flange.

6. The apparatus of claim 1 wherein the aperture comprises an elongate slot located in a lower portion of the front wall of the housing.

* * * * *